United States Patent [19]

Malone

[11] 4,308,883

[45] Jan. 5, 1982

[54] SUSPENDED TENT AND RAIN GUARD APPARATUS

[76] Inventor: Jerald C. Malone, 2424 Drusilla, No. 63, Baton Rouge, La. 70809

[21] Appl. No.: 68,912

[22] Filed: Aug. 23, 1979

[51] Int. Cl.[3] ..... A45F 1/12; A45F 3/22

[52] U.S. Cl. ..... 135/8; 5/121

[58] Field of Search ..... 135/8, 5 R, 1 R; 5/121, 5/123, 128

[56] References Cited

U.S. PATENT DOCUMENTS

| | | | |
|---|---|---|---|
| 495,532 | 4/1893 | Travers | 5/121 |
| 1,094,412 | 4/1914 | Ashworth | 5/121 |
| 1,156,200 | 10/1915 | Ashworth | 5/121 |
| 2,375,792 | 5/1945 | Kearny | 5/121 |
| 4,001,902 | 1/1977 | Hall et al. | 5/121 |
| 4,057,859 | 11/1977 | Setterholm | 5/121 |
| 4,071,917 | 2/1978 | Mojica | 5/121 |

*Primary Examiner*—J. Karl Bell

*Attorney, Agent, or Firm*—Charles C. Garvey, Jr.

[57] ABSTRACT

A personnel suspended tent and rain guard apparatus provides a personnel compartment having an upper rectangular elongated roof and a lower generally coplanar floor with a plurality of side walls connecting said upper roof and said floor. A pair of upper load lines attached respectively to the opposite and parallel sides of the roof with each load line having its end portions adapted for suspending supporting attachment to rigid members, such as trees. A pair of lower load line floor supporting members are attached respectively to the opposite end portions of the floor and extend in directions away from the floor during operation for attachment to a desired point of rigidity. Spreader brackets are provided at each end portion of the floor for laterally stressing the window personnel compartment suspended by the upper and lower load lines above the ground as occurs during operation. A rain fly guard is provided above the roof and attached generally to the roof at its periphery, the rain fly providing parabolic load carrying end portions adapted to receive tensile anchoring force from for example, a plurality of tensile peg anchors.

9 Claims, 4 Drawing Figures

SUSPENDED TENT AND RAIN GUARD APPARATUS

BACKGROUND OF THE INVENTION

1. Field of the Invention

The present invention relates to tents and hammock constructions which are adapted for use by personnel in environments where habitation a distance above the ground is desirable. The present invention further relates to a suspended tent and rain guard apparatus which allows a human user to sleep or rest in a suspended position a distance above the ground with gravitational, longitudinal, and lateral support being provided.

2. General Background and Prior Art

In the camping, and general outdoor industry, there is a numerous assortments of tents, hammocks, sleeping bags, and other such devices which are adapted for outdoor use and human comfort. The outdoor industry has long provided sleeping or habitation structure such as tents and the like which allow an individual to spend time in the outdoors despite the various inhospitable elements. Most such devices are adapted for placement on the ground and are then fastened and structurally supported using tent pegs, ropes, and other such tensile fasteners.

However, there are some harsh environments which prohibit or deter the use of a ground supported tent or like structure for example, in swampy or marshy or in regions where vermin, reptile, and other such undesirable creatures provide less incentive for spending time on the earth itself. Indeed, such environments usually prohibit the use of conventional tents and like structures on the actual earth surface when sleeping or other such activity for long periods of time is required.

In marshy environments, tents and other ground oriented structures are undesirable because of the wet floor they provide and further because water levels are unpredictable once a rain begins.

The outdoor industry has cost individual to move into these usually undesirable areas in the search of recreation, nature study, and other such activity.

There are many swamp areas of the country such as the Everglades in Florida and the Atchafalya swamp in Louisiana, which attract a greater number of individuals each year which persons are desirous to explore and understand and enjoy the swamp eco system they provide.

Thus, there can be seen a greater need for a structure which allows safe, comfortable, and structurally sound living above the ground in hostile or wet environments.

Hammocks are known which generally support an individual above the ground a desired distance. However, hammocks are known for their instability in that they show little or no resistance to lateral forces such as wind, and the like. Further, hammocks provide little or no protection from the intense rains and other such moist conditions which accompany a swamp or march eco system.

The use of hammocks is generally limited when applied to such harsh environments.

3. General Discussion of the Present Invention

The present invention solves the problems and shortcomings of the prior art in a simple and inexpensive manner.

The present invention provides a suspended tent and rain guard apparatus which is especially adapted for use in areas susceptible to moisture on the ground or to frequent rain showers and the like.

The present invention provides a suspended tent and rain guard apparatus having a personnel compartment which provides an upper horizontal elongated roof and a coplanar lower horizontal floor connected with a plurality of generally vertical or slanted side walls. A pair of upper load lines attached respectively to the opposite and parallel side portions of the roof and support at least in part a personnel compartment. A pair of lower load line floor supporting members attached to the opposite end portions of the floor and extend longitudinally away in directions away from the floor for attachment to a desired rigid point such as trees for example. Spreader brackets are provided at each end portion of the floor member for laterally stressing the floor when the personnel compartment is its desired suspended position. A rain fly guard is provided on the roof attached to the periphery thereof and extending in lateral directions a distance beyond the lateral dimensions of the roof thus providing a rain protective eave portion which is preferably downwardly slanted during operation, (See FIG. 3).

The upper load carrying lines can be elastic, and would generally hold the personnel compartment erect. The lower load lines would be of a strong material capable of supporting for example 90 to 95% of the weight of an individual occupying the personnel compartment. The rain fly guard provides parabolic end portions which stress the entire assembly in both longitudinal and lateral directions to provide a very stable yet structurally simple construction.

Thus, it is an object of the present invention to provide a suspended tent and rain guard apparatus adapted for use in a swamp or marsh environment.

It is another object of the present invention to provide a suspended tent and rain guard apparatus having rain guard capabilities and structurally sound wind attacked by lateral forces.

It is another object of the present invention to provide a suspended tent and rain guard apparatus having an upper rain fly guard having parabolic end portions which stress the entire assembly in both longitudinal and lateral directions.

It is a further object of the present invention to provide a suspended tent and rain guard apparatus which is simple to manufacture and easy to use.

It is another object of the present invention to provide a suspended tent and rain guard apparatus which is supported against gravitational and lateral forces.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
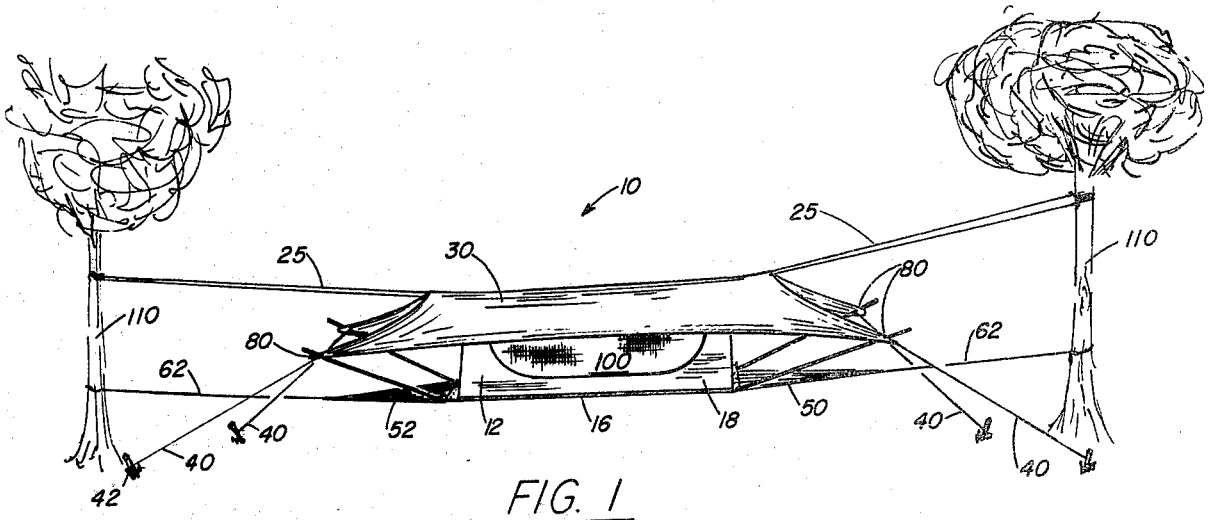
FIG. 1 is a side view of the preferred embodiment of the apparatus of the present invention as shown during operation.
Figure 2:
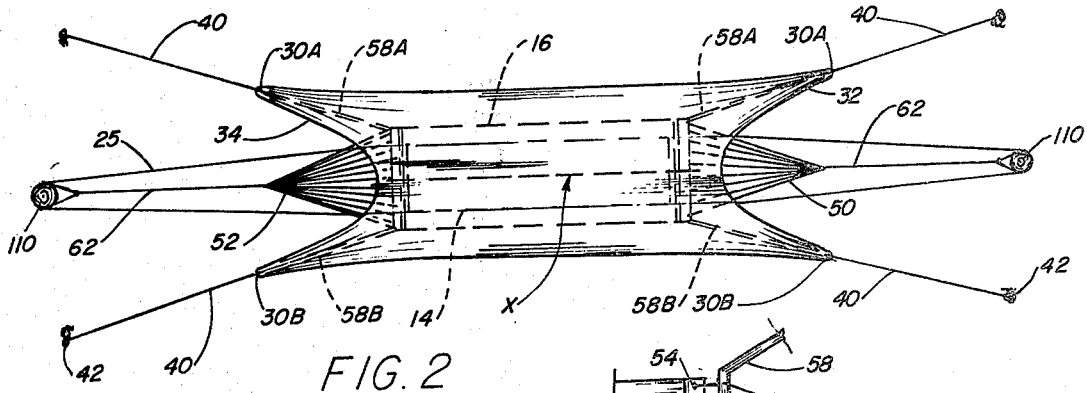
FIG. 2 is a top view thereof.
Figure 3:
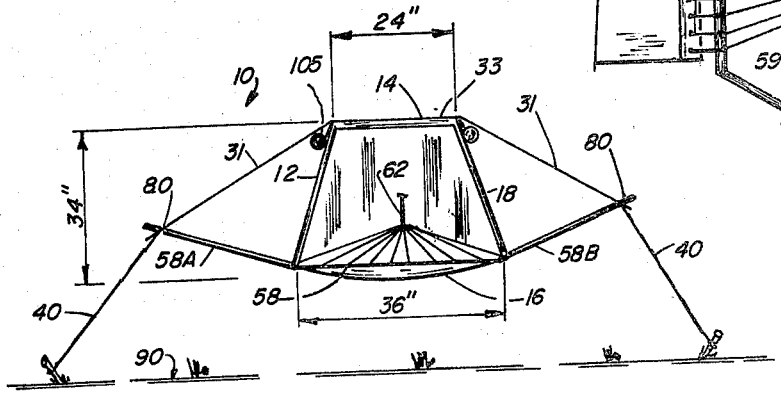
FIG. 3 is a partial end view thereof.

FIGS. 1–3 best illustrate the preferred embodiment of the apparatus of the present invention designated generally by the numeral 10. In FIGS. 1–3 there can be seen a suspended tent and rain guard apparatus 10 having a personnel compartment 12 which is comprised generally of an upper roof 14 and a lower floor 16. Roofs 14 and floor 16 are each preferably rectangular having a longitudinal axis designated generally by the letter "X" in FIG. 1.

A plurality of side walls 18 connect in a generally vertical or at least slanted direction between floor 16 and roof 14 as best seen in FIGS. 1 and 3.

Attached to roof 14 is rain fly guard 30. Rain guard 30 is best seen in FIG. 2 and has parabolic end portions 32, 34 which attach to a plurality of peg anchors 40 as best seen in FIGS. 1 and 2. As will be discussed more fully hereinafter, parabolic end portions 32, 34 provide both lateral and longitudinal stressing to rain guard 30 and provide excellent stability to the suspended tent and rain guard apparatus 10 of the present invention.

Figure 4:
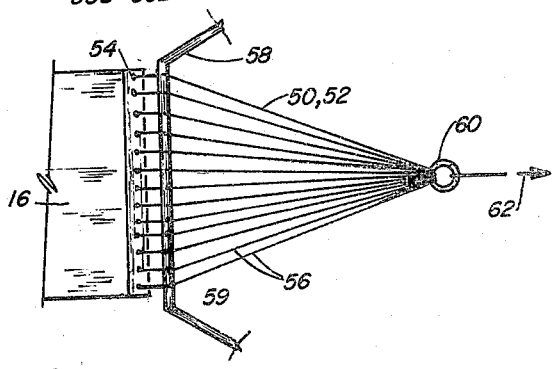
FIG. 4 is a partial top view of the preferred embodiment of the apparatus of the present invention illustrating the spreader bracket and lower load line attachment details.

Floor 16 is generally supported by means of lower load line members 50, 52. FIG. 4 best illustrates the construction of load line floor supporting members 50, 52 in a fragmentary view thereof. Note that the end portions of floor 16 is shown as viewed from the top or bottom in FIG. 4. A plurality of grommet openings 54 provide openings to which a plurality of load lines 56 attach through bracket 58. Note that bracket 58 provides a point for the attachment for lines 50, 52 thereto such points being indicated as 59 in FIG. 4. Lines 56 gather and attach to load ring 60 to which is attached a single tensile load line 62 which attaches to for example a desired point of rigidity such as a tree, as shown in FIG. 1.

It should be understood that load lines 62 will support the majority of weight of an individual which occupies personnel compartment 12.

Brackets 58 or spreader brackets as aforedescribed to spread load lines 56 as shown in FIG. 4.

Ring fly guard 30 is best seen in FIGS. 1, 2 and 3. Rain fly guard 30 provides parabolic end portions 32, 34 as well as a top 33 and side eaves 31. Eaves 31 are downwardly inclined during operation providing a lateral projection of rain fly guard 30 laterally a distance beyond the lateral dimensions of roof 14. At the ends of each parabolic end portion 32, 34 are provided grommets or other suitable attachments 30*a*, 30*b* adapted for attachment to peg anchor lines 40. Peg anchors 40 attached to anchor pegs 42 as best seen in FIGS. 1, 2 and 3 with peg anchors 42 being driven for example into the earth 90 as seen in FIG. 3.

Spreader brackets 58 provide spreader arms 58*a*, 58*b* as seen best in FIGS. 2 and 3. Spreader bracket arms 58*a*, 58*b* attach at the end portions thereof to the extreme end portions 30*a*, 30*b* of parabolic end portions 32, 34. The end portions 30*a*, 30*b* are of parabolic end portions 32, 34 can be for example grommets as aforedescribed.

Personnel compartment 12 is supported in an erect position by stabilizer lines 25. Stabilizer lines 25 can be for example elastic since there are preferably designed to only support the weight of roof 14, rain fly 30, and side walls 18.

The combination of stabilizer lines 25, peg anchors 40, and load lines 62 are all combined to provide the preferred embodiment of the apparatus of the present invention with excellent stability against gravitational loads as well as lateral forces, such as wind and rain.

In FIG. 1 there can be seen vent openings 100 which are for example a mesh screen or the like which allows air to pass through personnel compartment 12 providing ventilation thereto. Closures 105 as best seen in FIG. 3 would allow for privacy and a closure of openings 100. Closures 105 would be for example flexible sheet material of the same type of construction as rain fly 30.

Personnel compartment 12 could be manufactured of any light weight yet durable material such as rip stop nylon or the like. Preferably floor 16 would be of a heavier gage material since it would be required in combination with load line 62 to bare the majority of force acting upon the entire tent and rain guard apparatus 10.

Load lines 62 and peg anchors 40 would preferably be of a suitable structurally sound tensile rope material such as nylon or the like. Stabilizer lines 25 could be of nylon rope or the like or could be elastic to allow for some "play" in the movement of rain fly 30 in the wind for example. The attachment of rain fly 30 to bracket arms 58*a*, 58*b* is best shown in FIG. 3. Preferably stops would be provided on the end portions of brackets arms 58*a*, 58*b* which were larger than the diameter of the grommet openings or like attachments 80 provided at the end portions 80 of parabolic end portions 32, 34 of rain fly guard 30.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A suspended tent and rain guard apparatus comprising:

a. a personnel compartment comprising an upper rectangular elongated generally horizontal roof, a lower rectangular elongated floor generally coplanar with said roof, and a plurality of said side walls connecting said upper roof and said floor;

b. a pair of upper load lines attached respectively to two opposite and parallel sides of said roof and parallel with the longitudinal axis of said roof, each upper load line having attachment means at its opposite end portions or suspendly supporting at least a portion of said roof and said personnel compartment against gravitational forces;

c. a pair of lower load line floor supporting members attached respectively to opposite end portions of said floor and extending in directions away from said floor during operations, said lower load lines being generally parallel to the longitudinal axis of said floor, and said roof during operation;

d. spreader means provided at each end portion of said floor member for laterally stressing said floor when said personnel compartment is suspended by said upper and said lower load lines; and e. rain fly means above said roof and attaching to said roof at least in part to said roof at its periphery for bracing said personnel compartment against said lateral movement with respect to its longitudinal axis, said rain fly means having parabolic load carrying end portions, each of said end portions associated with a pair of tensile peg anchors for applying tensile force at least in part in a lateral direction to said fly means as said parabolic load carrying end portions.

2. The apparatus of claim 1 wherein said upper load lines are elastic at least in part.

3. The apparatus of claim 1 wherein said peg anchors stress said rain fly means at least in part in lateral and in longitudinal directions.

4. The apparatus of claim 1 wherein said spreader means is a generally rigid attachment in a lateral direction to the end portion of said floor and said bracket provides a pair of arms attached at the end corners of said floor and projecting laterally to and connecting to the lateral extreme end of said parabolic load carrying end portions.

5. The apparatus of claim 4 further comprising a pair of tensile peg anchors associated with each parabolic load carrying end portion for applying tensile force at least in part in a lateral direction to said rain fly means.

6. The apparatus of claim 5 wherein each tensile peg anchor attaches to said parabolic end portion at the attachment point of said arms thereto.

7. The apparatus of claim 4 wherein said bracket is generally u-shaped having arms which extend toward and connect to the end portions of said parabolic load carrying members in a direction generally away from said personnel compartment.

8. The apparatus of claim 1 wherein said personnel compartment provides air screen openings on at least some of said side walls, and said rain fly means projects laterally in each lateral direction a distance beyond the lateral dimensions of said roof, providing a protected eave over said openings.

9. The apparatus of claim 8 wherein said eaves are downwardly inclined during operation.

* * * * *